US009663317B2

(12) United States Patent
Wada

(10) Patent No.: US 9,663,317 B2
(45) Date of Patent: May 30, 2017

(54) SHEET PROCESSING DEVICE AND IMAGE FORMING APPARATUS INCLUDING THE SAME

(71) Applicant: KYOCERA Document Solutions Inc., Osaka-shi, Osaka (JP)

(72) Inventor: Hiroshi Wada, Osaka (JP)

(73) Assignee: KYOCERA Document Solutions Inc. (JP)

( * ) Notice: Subject to any disclaimer, the term of this patent is extended or adjusted under 35 U.S.C. 154(b) by 14 days.

(21) Appl. No.: 14/726,735

(22) Filed: Jun. 1, 2015

(65) Prior Publication Data

US 2015/0353314 A1 Dec. 10, 2015

(30) Foreign Application Priority Data

Jun. 4, 2014 (JP) ..... 2014-115402

(51) Int. Cl.
*B65H 29/70* (2006.01)
*B65H 29/12* (2006.01)
(Continued)

(52) U.S. Cl.
CPC ..... *B65H 29/125* (2013.01); *B65H 29/70* (2013.01); *B65H 31/02* (2013.01); *B65H 43/06* (2013.01);
(Continued)

(58) Field of Classification Search
CPC B65H 31/32; B65H 31/24; B65H 2301/5122; B65H 2301/51256;
(Continued)

(56) References Cited

U.S. PATENT DOCUMENTS 7,992,863 B2 * 8/2011 Jacobs ..... B65H 29/70 271/188
8,213,854 B2 * 7/2012 Iida ..... B65H 5/26 270/58.08
(Continued)

FOREIGN PATENT DOCUMENTS

JP 2002-196653 7/2002
JP 2006-62855 3/2006
JP 201163426 A 3/2011
JP 2011-68451 4/2011
(Continued)

OTHER PUBLICATIONS

Japanese Office Action Dated Apr. 12, 2016.

*Primary Examiner* — Ernesto Suarez
(74) *Attorney, Agent, or Firm* — Gerald E. Hespos; Michael J. Porco; Matthew T. Hespos

(57) ABSTRACT

A sheet processing device includes a housing, a sheet stacking portion, a sheet discharge portion, a contact member, a conveyance unit, and an association mechanism. A sheet discharge portion is disposed in the housing and faces a space over the sheet stacking portion, the sheet discharge portion including a pair of discharge rollers. The contact member is disposed in the sheet discharge portion, and is movable to project into a sheet conveyance passage to come into contact with a surface of the sheet. The conveyance unit is selectively mounted in the space of the housing, and is configured to receive a sheet delivered by the pair of discharge rollers and convey the sheet. The association mechanism is operable to cause the contact member to recede from the sheet conveyance passage in association with the mounting of the conveyance unit in the housing.

6 Claims, 12 Drawing Sheets

(51) Int. Cl.
*B65H 31/02* (2006.01)
*B65H 43/06* (2006.01)

(52) U.S. Cl.
CPC ..... *B65H 2301/4212* (2013.01); *B65H 2301/5122* (2013.01); *B65H 2301/51214* (2013.01); *B65H 2301/512565* (2013.01); *B65H 2402/10* (2013.01); *B65H 2402/32* (2013.01); *B65H 2403/51* (2013.01); *B65H 2404/63* (2013.01); *B65H 2404/64* (2013.01); *B65H 2404/693* (2013.01); *B65H 2511/51* (2013.01); *B65H 2553/612* (2013.01); *B65H 2553/83* (2013.01); *B65H 2801/27* (2013.01)

(58) Field of Classification Search
CPC ..... B65H 2405/32; B65H 2405/324; B65H 2801/24; B65H 2801/27; B65H 29/70; B65H 2404/64
See application file for complete search history.

(56) References Cited

U.S. PATENT DOCUMENTS

| | | | | |
|---|---|---|---|---|
| 8,240,662 | B2 * | 8/2012 | Yahata | B65H 31/02 271/207 |
| 8,608,150 | B2 * | 12/2013 | Okumura | B41J 3/44 270/32 |
| 9,550,647 | B1 * | 1/2017 | Flynn | B65H 29/58 |
| 2010/0194026 | A1 * | 8/2010 | Iguchi | B65H 7/12 271/3.15 |
| 2010/0252989 | A1 | 10/2010 | Jacobs | |
| 2011/0076078 | A1 | 3/2011 | Yoshida | |
| 2012/0128397 | A1 * | 5/2012 | Chang | B65H 29/125 399/406 |

FOREIGN PATENT DOCUMENTS

| | | | |
|---|---|---|---|
| JP | 2013195680 | A | 9/2013 |

* cited by examiner

SHEET PROCESSING DEVICE AND IMAGE FORMING APPARATUS INCLUDING THE SAME

INCORPORATION BY REFERENCE

This application is based on Japanese Patent Application No. 2014-115402 filed with the Japan Patent Office on Jun. 4, 2014, the contents of which are hereby incorporated by reference.

BACKGROUND

The present disclosure relates to a sheet processing device and an image forming apparatus including the same.

Conventionally, there are known sheet processing devices which can discharge a sheet in such a manner as to form a stack of sheets on a specific sheet stacking portion. Such a sheet processing device is mounted in an image forming apparatus for forming an image on a sheet. A pair of discharge rollers provided in the sheet processing device discharges a sheet having a surface subjected to image formation, for example, by using an electrographic technique, onto the sheet stacking portion. Further, there are known image forming apparatuses including a rigidity imparting member provided near the pair of discharge rollers, the strength imparting member being able to come into contact with a surface of a sheet to thereby form undulations to the sheet. This improves the sheet stacking performance on the sheet stacking portion. Further, there is disclosed a technique of mounting an optional device in an apparatus body after dismounting the strength imparting member from the apparatus body in the above-described apparatus.

A conveyance unit, which receives a sheet from the pair of discharge rollers and further conveys the sheet, is known as an example of the optional device to be mounted in the image forming apparatus.

SUMMARY

A sheet processing device according to an aspect of the present disclosure includes a housing, a sheet stacking portion, a sheet discharge portion, a contact member, a biasing member, a conveyance unit, and an association mechanism. The sheet stacking portion is disposed in the housing and has a top surface for allowing sheets to be stacked thereon. A sheet discharge portion is disposed in the housing and faces a space over the sheet stacking portion, the sheet discharge portion including a pair of discharge rollers configured to discharge a sheet to the sheet stacking portion. The contact member is disposed in the sheet discharge portion, and is movable to project into a sheet conveyance passage to come into contact with a surface of the sheet. The biasing member biases the contact member so that the contact member projects into the sheet conveyance passage. The conveyance unit is selectively mounted in the space of the housing to thereby face the sheet discharge portion, and is configured to receive a sheet delivered by the pair of discharge rollers and convey the sheet. The association mechanism is operable to cause the contact member to recede from the sheet conveyance passage against the biasing force of the biasing member in association with the mounting of the conveyance unit in the housing.

An image forming apparatus according to another aspect of the present disclosure includes an image forming section, and the above-described sheet processing device. The image forming section is operable to form an image on a sheet. The sheet processing device is operable to discharge the sheet formed with the image.

These and other objects, features and advantages of the present disclosure will become more apparent upon reading the following detailed description along with the accompanying drawings.

DETAILED DESCRIPTION

Figure 1:
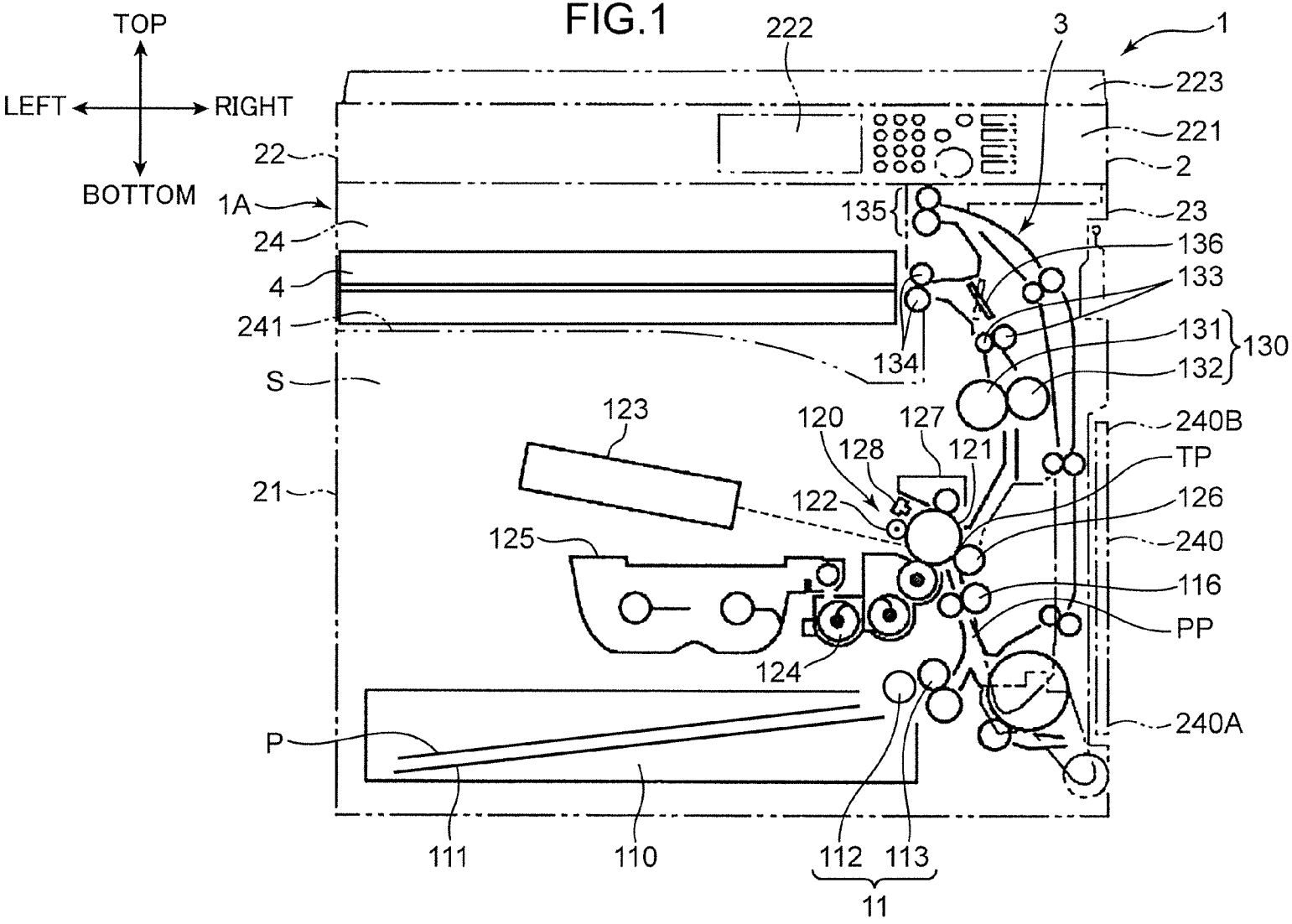
FIG. 1 is an internal sectional view of an image forming apparatus according to an embodiment of the present disclosure.
Figure 2:
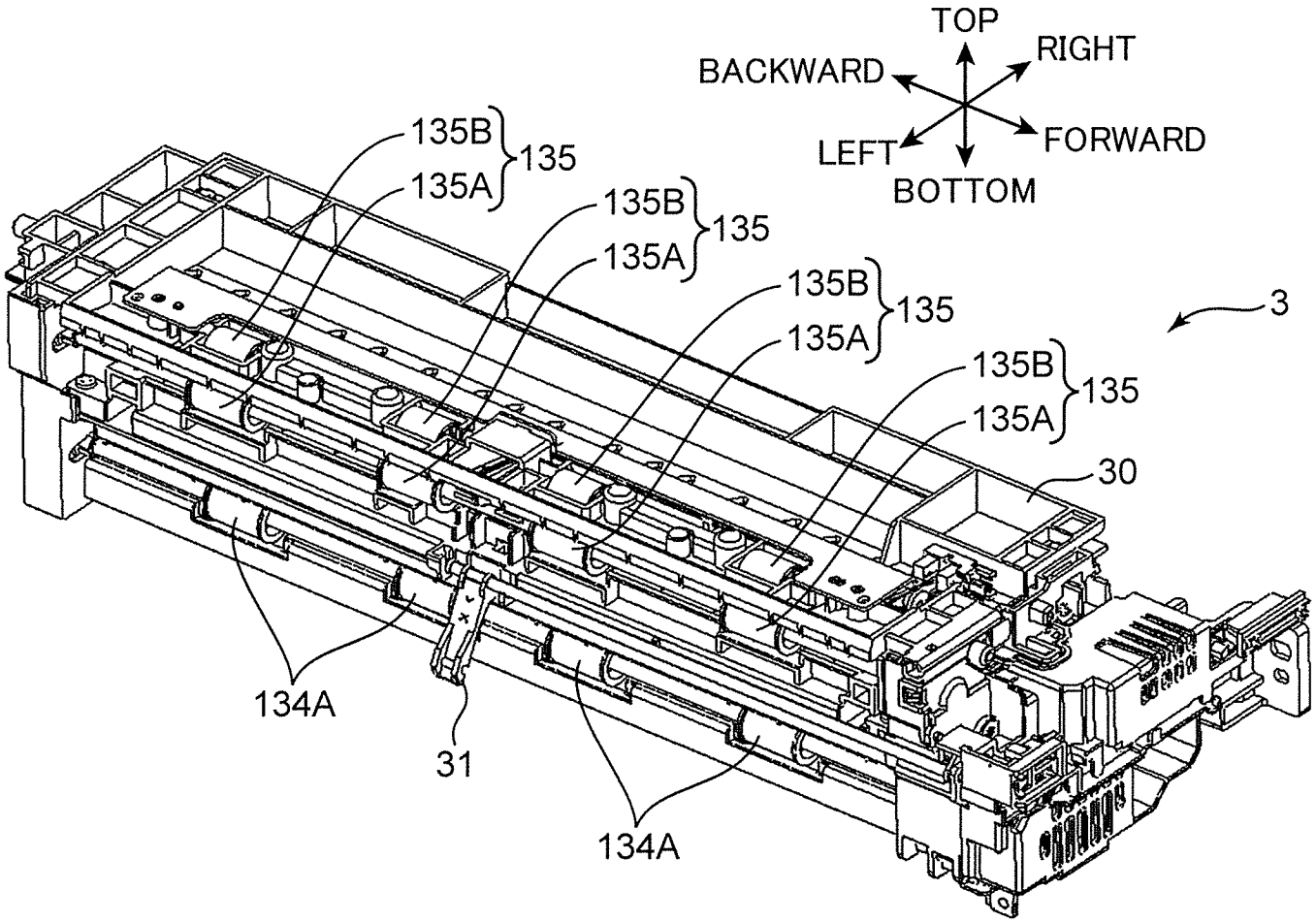
FIG. 2 is a perspective view of a sheet discharge portion according to a first embodiment of the present disclosure.
Figure 3:
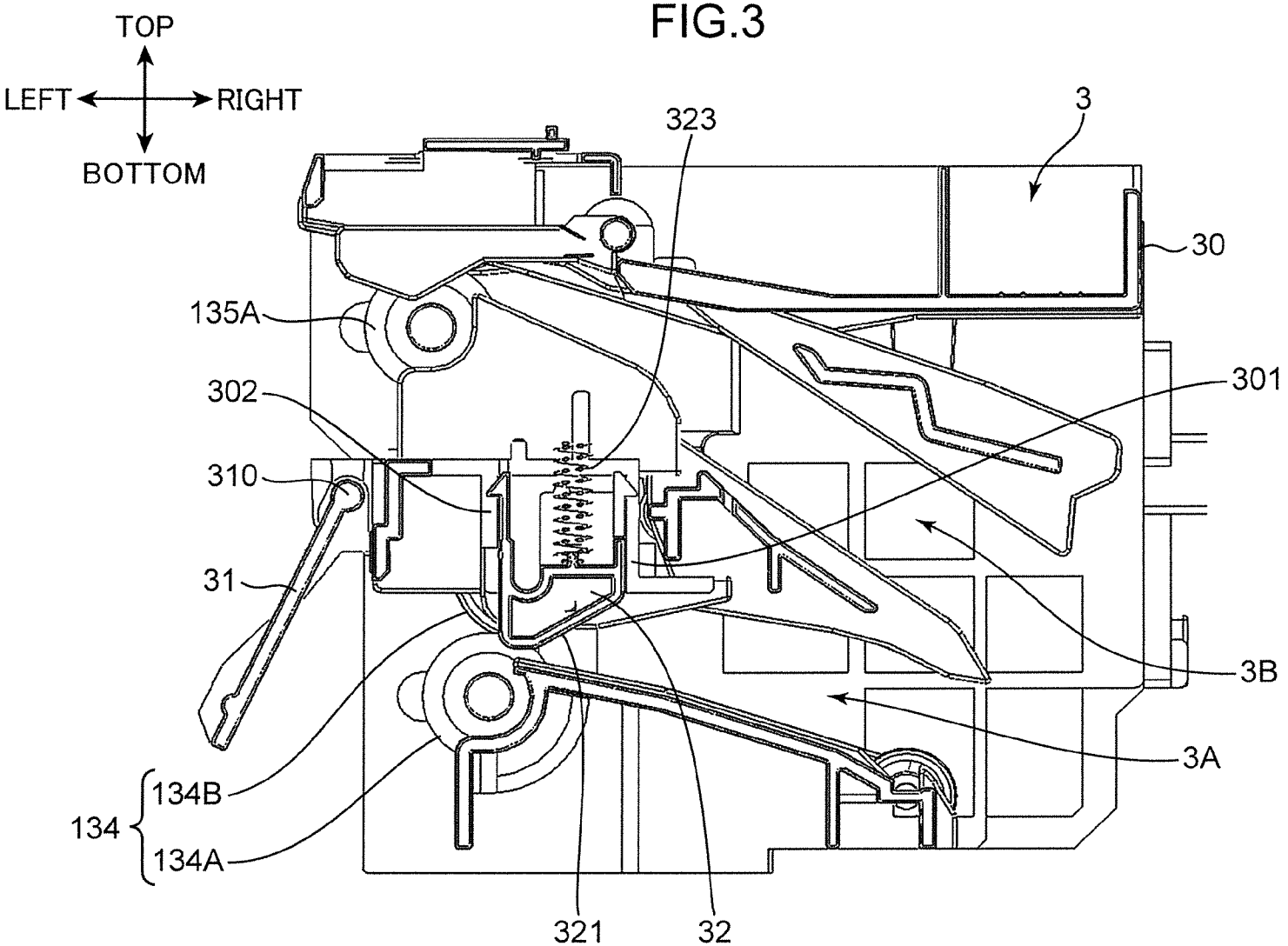
FIG. 3 is a sectional view of the sheet discharge portion according to the first embodiment of the present disclosure.

Hereinafter, an embodiment of the present disclosure will be described with reference to the accompanying drawings. FIG. 1 is an internal sectional view of an image forming apparatus 1 according to a first embodiment of the present disclosure. FIG. 2 is a perspective view of a discharge section 3 according to the first embodiment. FIG. 3 is a sectional view of the discharge section 3. The image forming apparatus 1 shown in FIG. 1 is illustrated as a so-called multifunction monochrome printer. However, the image forming apparatus may alternatively be configured as another type of apparatus for forming a toner image, an ink image, or the like on a sheet, such as a multifunction color printer, a color printer, or a facsimile apparatus in other embodiments. It should be noted that hereinafter, terms indicating directions such as "top" "bottom" "forward" "backward" "left" and "right" are intended merely for descriptive purposes, and not to limit the principle of the image forming apparatus. In addition, the term "sheet" used hereinafter will refer to a copy paper, a coated paper, an OHP sheet, a thick paper, a postcard, a tracing paper, or other sheet matter which is subjected to image formation or any other processing.

The image forming apparatus 1 includes a main housing 2 having a substantially rectangular parallelepiped shape. The main housing 2 includes a lower housing portion 21 (housing) having a substantially rectangular parallelepiped shape, and an upper housing portion 22 disposed over the lower housing portion 21 and having a substantially rectangular parallelepiped shape. The lower housing portion 21 includes a connecting housing part 23 connecting with the upper housing portion 22. The connecting housing part 23 extends along the right and rear edges of the main housing 2. The lower housing portion 21 and the upper housing portion 22 define a discharge space 24 (space), into which a printed sheet is discharged. In particular, in the present embodiment, a sheet is discharged onto a sheet receiving section 241 disposed on a top surface of the lower housing portion 21, thereby resulting in a stack of sheets. The discharge space 24 is defined over the sheet receiving section 241. An intermediate conveyance unit 4 described later can be mounted in the discharge space 24.

On the front side of the upper housing portion 22 is disposed an operation section 221 which includes, for example, an LCD touch panel 222. The operation section 221 can receive input of information relating to image formation. The LCD touch panel 222 allows a user to set the number, the print density or the like of sheets to be printed, for example. The upper housing portion 22 mainly houses components for reading an image of an original document sheet and an electronic circuit for controlling the entire operation of the image forming apparatus 1.

On the upper housing portion 22 is disposed a hold cover 223 which is used to hold an original document sheet. The hold cover 223 is mounted on the upper housing portion 22 in a vertically pivotable manner.

On the right side surface of the lower housing portion 21 is disposed a manual feed tray 240. The manual feed tray 240 is vertically pivotable about a lower end 240A. The lower housing portion 21 defines an internal space S in which various components described later are placed.

The image forming apparatus 1 includes in the internal space S a cassette 110, a sheet feeding section 11, a pair of registration rollers 116, an image forming section 120, a fixing device 130, and the discharge section 3 (sheet discharge portion). The sheet feeding section 11 includes a pickup roller 112 and a sheet feeding roller 113. The sheet feeding roller 11 feeds a sheet P to a sheet conveyance passage PP. The sheet conveyance passage PP extends from the sheet feeding section 11 and passes through the pair of registration rollers 116 and a transfer position TP in the image formation section 120.

The cassette 110 stores sheets P therein. The cassette 110 includes a lift plate 111 for supporting the sheets P. The lift plate 111 is tilted to raise the leading edges of the sheets P.

The pair of registration rollers 116 regulates the position of a sheet P in a direction perpendicularly intersecting the direction of conveyance of the sheet P. The pair of registration rollers 116 supplies the sheet P to the image forming section 120 in accordance with a timing at which a toner image will be transferred onto the sheet P in the image forming section 120.

The image forming section 120 includes a photoconductive drum 121, a charger 122, an exposure device 123, a developing device 124, a toner container 125, a transfer roller 126, a cleaning device 127, and a discharger 128.

The fixing device 130 includes a heating roller 131 for melting toner on a sheet P, and a pressure roller 132 for bringing the sheet P into close contact with the heating roller 131.

The discharge section 3 is disposed above the fixing device 130. The discharge section 3 faces the discharge space 24 in the left-right direction. The discharge section 3 functions to discharge a sheet P formed with an image in such a manner as to form a stack of sheets P. The discharge section 3 includes a discharge housing 30. The discharge housing 30 serves as an enclosure of the discharge section 3, and has a substantially rectangular parallelepiped shape as shown in FIG. 2.

Further, the discharge section 3 includes a pair of conveying rollers 133 disposed downstream of the fixing device 130, and a changer 136 disposed downstream of the pair of conveying rollers 133. The pair of conveying rollers 133 conveys a sheet P subjected to the fixing by the fixing device 130 downstream in the sheet conveyance direction. The changer 136 functions to change the direction of conveyance of a sheet P at the downstream side of the pair of conveying rollers 133 in the sheet conveyance direction. The conveyance direction of a sheet P is changed by the changer 136 so that the sheet enters a first conveyance passage 3A or a second conveyance passage 3B (FIG. 3).

The discharge section 3 further includes first pairs of discharge rollers 134 (pair of discharge rollers) and second pairs of discharge rollers 135. The first pairs of discharge rollers 134 are disposed on the left side of the changer 136 (FIG. 1), and discharge a sheet P conveyed by the pair of conveying rollers 133 into the discharge space 24 (the sheet receiving section 241). When the intermediate conveyance unit 4 described later is not mounted, a sheet P discharged by the first pairs of discharge rollers 134 falls on the sheet receiving section 241 to augment a stack of sheets. Each of the first pairs of discharge rollers 134 includes a first driving roller 134A and a first driven roller 134B (FIG. 3). The respective pluralities of first driving rollers 134A and first driven rollers 134B are disposed at intervals in an axial direction (in the forward-backward direction) (see FIG. 2).

The second pairs of discharge rollers 135 are disposed above the first pairs of discharge rollers 134, and discharge a sheet P conveyed by the pair of conveying rollers 133 into the discharge space 24. Each of the second pairs of discharge rollers 135 includes a second driving roller 135A and a second driven roller 135B. The respective pluralities of second driving rollers 135A and second driven rollers 135B are disposed at intervals in the axial direction (in the forward-backward direction).

Further, the discharge section 3 includes a detection member 31 and a plurality of strength imparting members 32 (contact member). The detection member 31 is pivotable about an axis of a support portion 310 (FIG. 3) with respect to the discharge housing 30. As shown in FIG. 2, the detection member 31 is disposed in the middle of the discharge housing 30 in the forward-backward direction. Further, as shown in FIG. 3, the detection member 31 is disposed on the left side of the first pairs of discharge rollers 134. The detection member 31 constitutes a part of an actuator for detecting a state that a maximum number of sheets P are stacked on the sheet receiving section 241. Each sheet P discharged by the first pairs of discharge rollers 134 comes into contact with the detection member 31 in the course of being discharged onto the sheet receiving section 241. Each time a sheet P is cumulatively discharged on the sheet receiving section 241, the detection member 31 pivots and the tip end thereof shifts upward. When the maximum number of sheets P are stacked on the sheet receiving section 241, an unillustrated PI sensor detects the detection member 31, and the information reporting the stacking of the maximum number of sheets P is displayed on the LCD touch panel 222.

The strength imparting members 32 are respectively disposed between respective adjacent first pairs of discharge rollers 134 in the forward-backward direction. The strength imparting members 32 project into the first conveyance passage 3A (sheet conveyance passage) to come into contact with a surface of a sheet P to thereby impart rigidity to the sheet P, the first conveyance passage 3A allowing the sheet P to be discharged by the first pairs of discharge rollers 134 to pass therethrough. Each of the strength imparting members 32 is slidable vertically (in a direction intersecting the direction of conveyance of a sheet P, i.e. in a direction of receding from the first conveyance passage 3A) along a respective first guide portion 301 and a respective second guide portion 302 (FIG. 3) provided in the discharge housing 30. Further, the discharge housing 30 includes biasing springs 323 (biasing member). The biasing springs 323 respectively bias each of the strength imparting members 32 so that they project into the first conveyance passage 3A. A sheet P subjected to the fixing by the fixing device 130 is liable to curl. In consideration of this problem, the strength imparting members 32 are made to project into the first conveyance passage 3A to come into contact with a surface of the sheet P to thereby form undulations on the sheet P. The undulations impart rigidity to the sheet P (corrugation function), which improves the stacking performance of a plurality of sheets P on the sheet receiving section 241.

Figure 4:
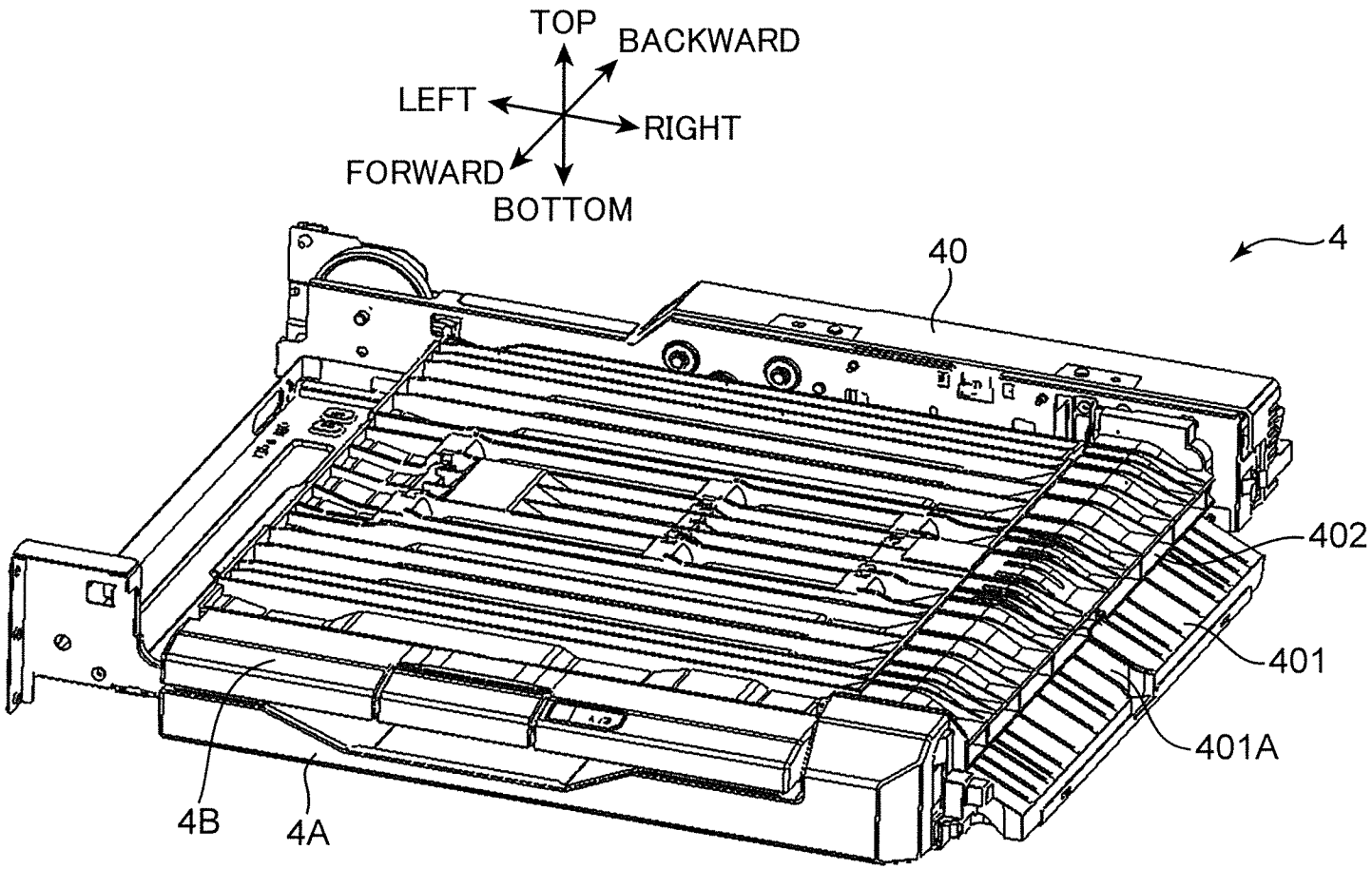
FIG. 4 is a perspective view of a conveyance unit according to the first embodiment of the present disclosure.
Figure 5:
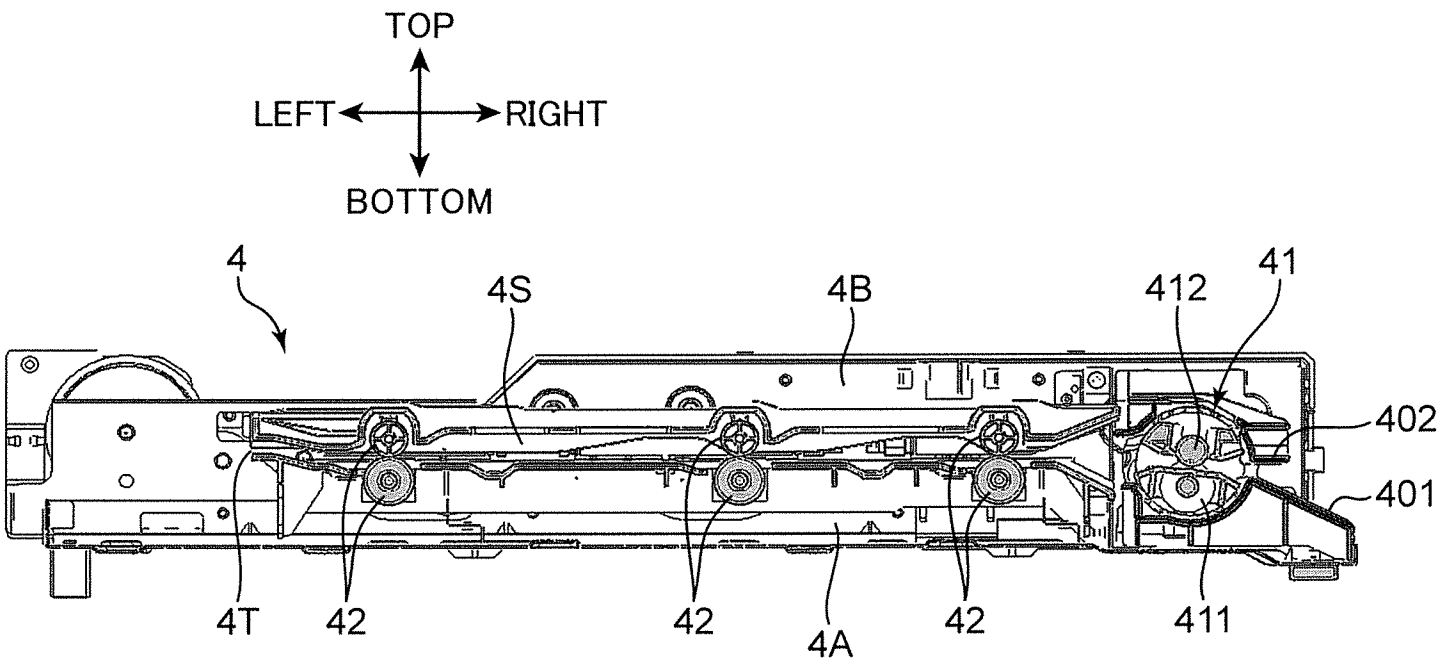
FIG. 5 is an internal sectional view of the conveyance unit according to the first embodiment of the present disclosure.

Further, the image forming apparatus 1 includes the intermediate conveyance unit 4 (conveyance unit). FIG. 4 is a perspective view of the intermediate conveyance unit 4 according to the first embodiment. FIG. 5 is an internal sectional view of the intermediate conveyance unit 4. The intermediate conveyance unit 4 receives a sheet P discharged from the discharge section 3 and conveys the sheet P to an unillustrated post-processing device. In the image forming apparatus 1 according to the first embodiment, the fixing device 130 and the discharge section 3 are disposed in the right portion of the lower housing portion 21, and the post-processing device is optionally mounted on the left side of the lower housing portion 21. Therefore, the intermediate conveyance unit 4 conveys a sheet P in a horizontal direction from the right end side toward the left end side of the lower housing portion 21. The post-processing device receives the sheet P from the intermediate conveyance unit 4 and performs a specific post-processing on the sheet P to form a stack of sheets. Examples of the post-processing on the sheet P include stapling and binding of a small booklet.

With reference to FIGS. 4 and 5, the intermediate conveyance unit 4 has a flat shape extending in the forward-backward and left-right directions. The intermediate conveyance unit 4 is selectively mounted in the discharge space 24 of the image forming apparatus 1. Specifically, the intermediate conveyance unit 4 enters the discharge space 24 from the left side of the image forming apparatus 1 to face the discharge section 3, thereby being mounted to the lower housing portion 21. In other embodiments, the image forming apparatus 1 may be configured to allow the intermediate conveyance unit 4 to enter the discharge space 24 from the front side thereof and then move slightly rightward, thereby being mounted to the lower housing portion 21. The intermediate conveyance unit 4 includes a lower unit portion 4A, an upper unit portion 4B, an intermediate conveyance passage 4S, a driver 40, a lower carry-in portion 401, an upper carry-in portion 402, a decurler unit 41, pairs of intermediate conveyance rollers 42, and an intermediate discharge port 4T.

The intermediate conveyance passage 4S extends horizontally in the intermediate conveyance unit 4. The lower unit portion 4A is disposed in a lower part of the intermediate conveyance unit 4 and has a flat shape, thereby defining the bottom of the intermediate conveyance passage 4S. Similarly, the upper unit portion 4B is disposed in an upper part of the intermediate conveyance unit 4 and has a flat shape, thereby defining the top of the intermediate conveyance passage 4S. The upper unit portion 4B is pivotable about its rear end in a direction to move the front end thereof upward with respect to the lower unit portion 4A, to thereby remove a sheet P jammed in the intermediate conveyance passage 4S. The driver 40 is disposed at a rear end of the intermediate conveyance unit 4, and mainly houses a motor for driving the decurler unit 41, the pairs of intermediate conveyance rollers 42 and the like. The lower carry-in portion 401 is disposed at a right end of the lower unit portion 4A and guides a sheet P to the intermediate conveyance passage 4S. Similarly, the upper carry-in portion 402 is disposed at the right end of the upper unit portion 4B and guides the sheet P to the intermediate conveyance passage 4S in cooperation with the lower carry-in portion 401.

The decurler unit 41 is disposed at the right end of the intermediate conveyance unit 4. The decurler unit 41 functions to eliminate curling of a sheet P. The decurler unit 41 includes an elastic roller 411 and a hard roller 412. The elastic roller 411 is made of a rubber material. The hard roller 412 is made of a metal. The hard roller 412 comes into contact with the elastic roller 411 to elastically deform the elastic roller 411. This allows a curved nip to be defined which extends along the circumference of the hard roller 412. A sheet P passes through the nip, where curing of a sheet P is eliminated. Further, the decurler unit 41 is rotatable around the axis of an unillustrated rotary shaft. Therefore, the vertical positions of the elastic roller 411 and the hard roller 412 can be reversed, which makes it possible to eliminate up curing and down curing of the leading end of a sheet P, regardless of any curing directions.

The pairs of intermediate conveyance rollers 42 are disposed in the intermediate conveyance passage 4S. The intermediate discharge port 4T is at the terminal end of the intermediate conveyance passage 4S, through which a sheet P is delivered to the unillustrated post-processing device.

The following defects are liable to occur if the intermediate conveyance unit 4 as described is mounted in the lower housing portion 21, and a sheet P subjected to formation of undulations by the above-described strength imparting members 32 is conveyed into the intermediate conveyance unit 4 while maintaining the undulations. In the intermediate conveyance unit 4, the upper unit portion 4B and the lower unit portion 4A define the top and the bottom of the intermediate conveyance passage 4S, respectively. Therefore, if the sheet P subjected to formation of undulations by the strength imparting members 32 passes through the intermediate conveyance passage 4S, the sheet P is liable to rub strongly against the respective surfaces of the upper unit portion 4A and the lower unit portion 4B, which may result in failure in conveyance of the sheet P and generation of abnormal noise. Further, in the case where the intermediate conveyance unit 4 includes the decurler unit 41 as in the present embodiment, there is no need to form undulations on a sheet P by the strength imparting members 32. The strength imparting members 32 function effectively in the case where a sheet P is conveyed onto the sheet receiving section 241.

Figure 6A:
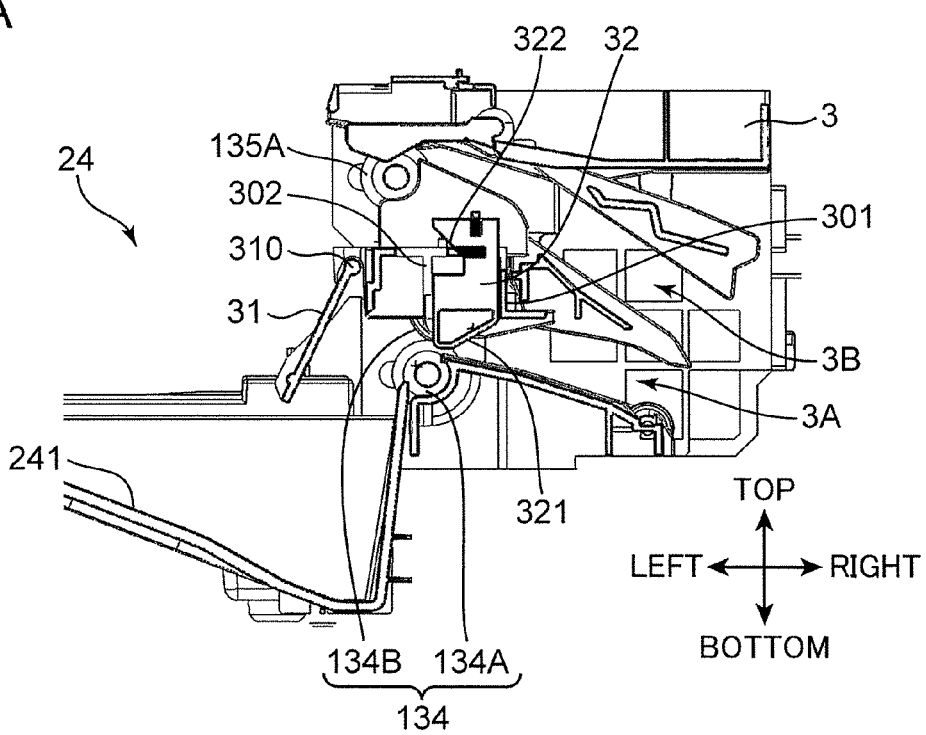
FIGS. 6A and 6B are sectional views illustrating mounting of the conveyance unit in a housing including the sheet discharge portion in the first embodiment of the present disclosure.
Figure 6B:
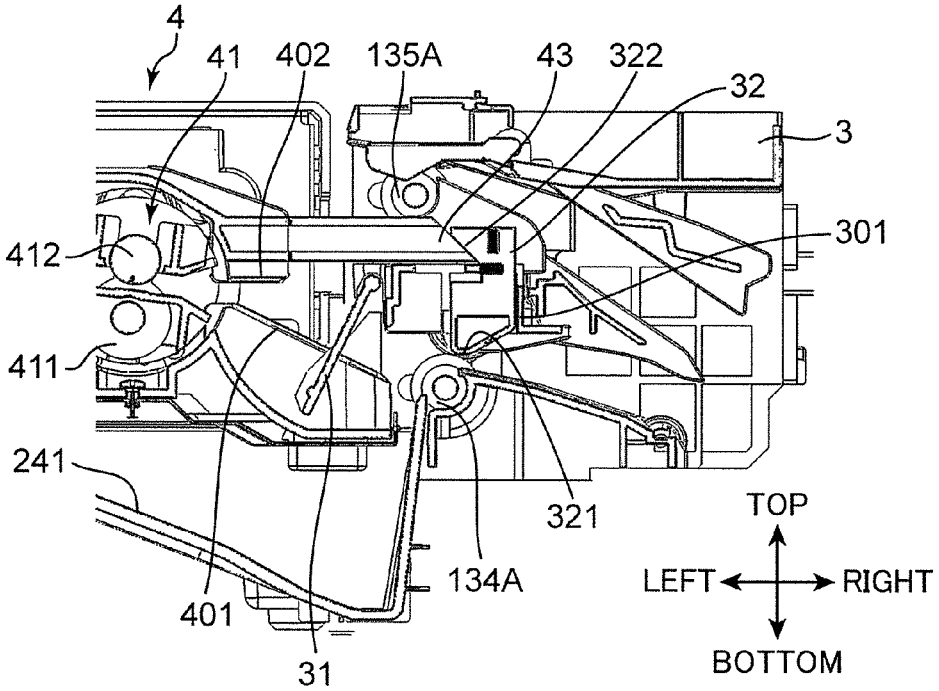

In the present embodiment, in order to eliminate the above-described defects that are liable to occur when the intermediate conveyance unit 4 is mounted in the lower housing portion 21, the intermediate conveyance unit 4 includes a plurality of protrusions 43 (association mechanism) (FIG. 6B). FIGS. 6A and 6B are sectional views illustrating mounting of the intermediate conveyance unit 4 in the lower housing portion 21 including the discharge section 3 in the present embodiment. In the present embodiment, the above-described lower housing portion 21 and intermediate conveyance unit 4 constitute a sheet processing device 1A (FIG. 1). The sheet processing device 1A functions to discharge a sheet P in such a manner as to form a stack of sheets.

With reference to FIG. 6B, the protrusions 43 protrude from the intermediate conveyance unit 4 into the discharge section 3. Although the protrusions 43 are not shown in FIG. 4, the protrusions 43 protrude rightward from the upper carry-in portion 402 of the intermediate conveyance unit 4. Further, the front end of each of the protrusions 43 has an oblique surface sloping downward in the direction of mounting of the intermediate conveyance unit 4 (to the right). Further, because the plurality of strength imparting members 32 are disposed at intervals in the forward-backward direction as described above, the plurality of protrusions 43 are so disposed as to respectively face each of the strength imparting members 32. The protrusions 43 function to cause the strength imparting members 32 to recede from the first conveyance passage 3A in association with the mounting of the intermediate conveyance unit 4 in the lower housing portion 21.

With reference to FIG. 6A, each of the strength imparting members 32 includes a sheet abutting portion 321 and a connected portion 322. The biasing springs 323 shown in FIG. 3 are respectively placed in the spaces defined in each of the strength imparting members 32. The sheet abutting portion 321 is disposed at a lower end of the strength imparting member 32. The sheet abutting portion 321 includes an oblique surface sloping downward in the direction of conveyance of a sheet P in the first conveyance passage 3A. Further, the sheet abutting portion 321 includes a flat surface extending in the conveyance direction in its front part. The connected portion 322 is disposed at an upper side of the strength imparting member 32. The connected portion 322 is defined by a cutout formed in the left end of the strength imparting member 32. The connected portion 322 is in the form of an oblique surface sloping downward in the direction of mounting of the intermediate conveyance unit 4 (to the right). As described above, the strength imparting member 32 is biased downward by the biasing spring 323 (FIG. 3), and slidable vertically (in the direction intersecting the direction of conveyance of a sheet P) along the first guide portion 301 and the second guide portion 302. The biasing force exerted by the biasing spring 323 is greater than the pushing force on the strength imparting member 32 exerted by a sheet P being conveyed in the first conveyance passage 3A.

Upon insertion of the intermediate conveyance unit 4 in the discharge space 24 from the left, i.e. change from the state shown in FIG. 6A to the state shown in FIG. 6B, the protrusions 43 of the intermediate conveyance unit 4 respectively come into contact with each of the connected portions 322 of the strength imparting members 32 through unillustrated openings formed in the discharge housing 30. At this time, the strength imparting member 32 is slid upward along the first guide portion 301 and the second guide portion 302 against the biasing force exerted by the biasing spring 323, owing to the contact of the oblique surface of the front end of the protrusion 43 with the oblique surface of the connected portion 322. This allows the sheet abutting portion 321 of the strength imparting member 32 to recede upward from the first conveyance passage 3A. Therefore, it is possible, when a sheet P formed with an image is delivered from the discharge section 3 to the intermediate conveyance unit 4, to prevent the strength imparting members 32 from coming into contact with the top surface of the sheet P and thereby prevent the sheet P from entering the intermediate conveyance unit 4 with undulations formed thereon. This can prevent failure in conveyance of the sheet P and generation of abnormal noise in the intermediate conveyance unit 4. Further, the contact of the protrusions 43 provided in the intermediate conveyance unit 4 with the strength imparting members 32 reliably allows the strength imparting members 32 to recede from the first conveyance passage 3A. Upon dismounting of the intermediate conveyance unit 4 from the lower housing portion 21, the strength imparting members 32 are slid downward by the biasing forces exerted by the respective biasing springs 323. At this time, as shown in FIG. 3, each of the strength imparting members 32 is settled at a protrusion position by a pair of fastening hooks provided at an upper end thereof.

Figure 7A:
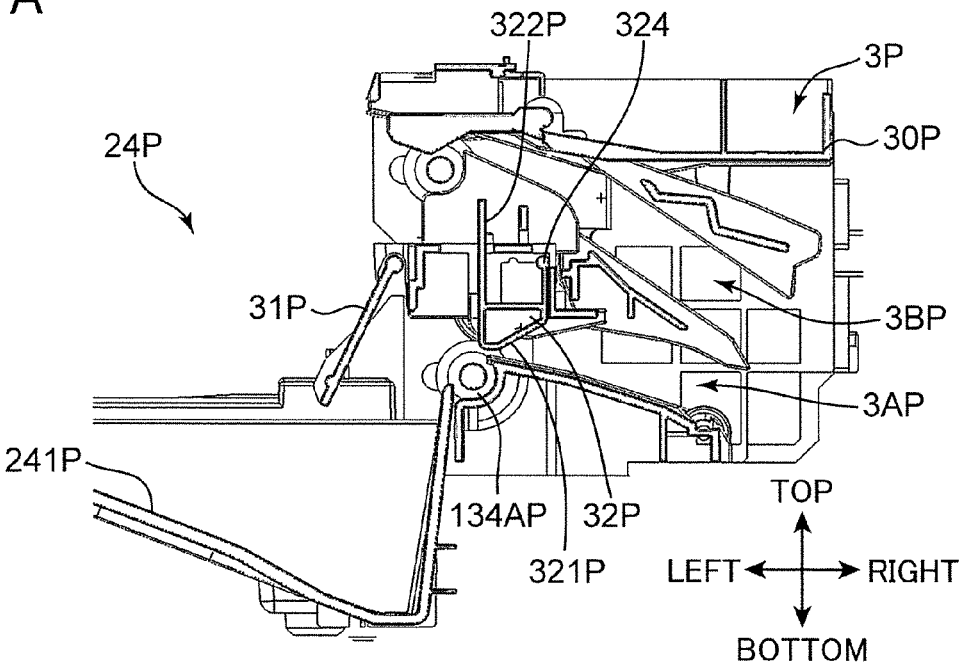
FIGS. 7A and 7B are sectional views illustrating mounting of a conveyance unit in a housing including a sheet discharge portion in a second embodiment of the present disclosure.
Figure 7B:
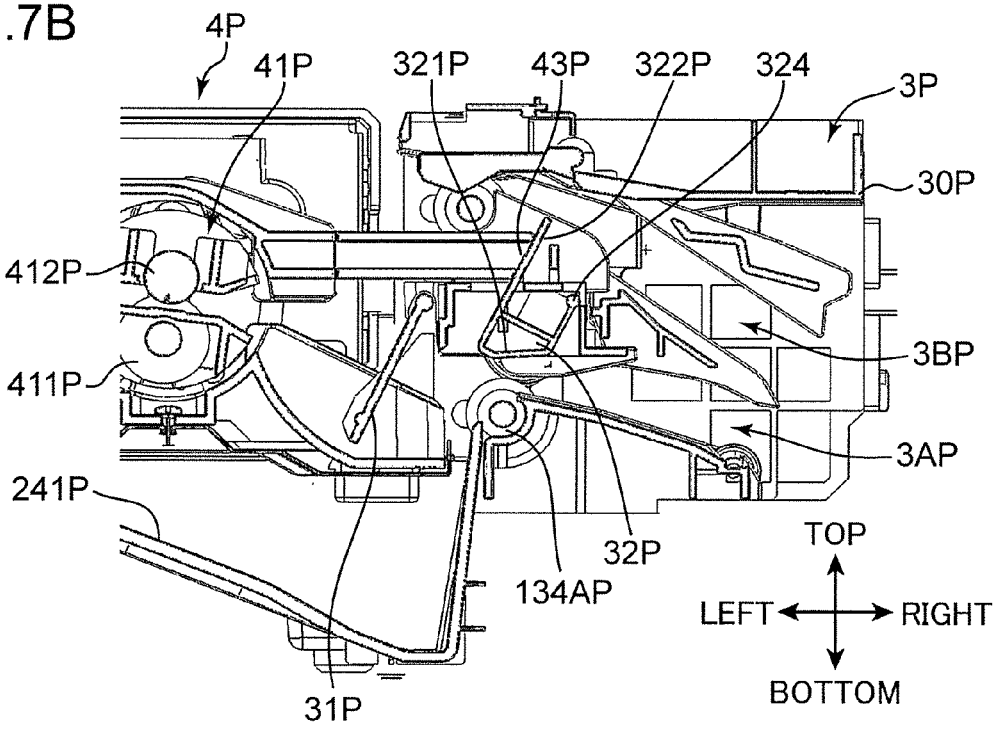

Now an image forming apparatus including a sheet processing device according to a second embodiment of the present disclosure will be described. FIGS. 7A and 7B are sectional views illustrating mounting of an intermediate conveyance unit 4P (conveyance unit) in a lower housing portion (not shown) including a discharge section 3P in the second embodiment. The second embodiment differs from the first embodiment in the respect of having a different support structure of each of strength imparting members 32P. Accordingly, description will be made mainly regarding the difference, and repeated description of other common features will be omitted. In FIGS. 7A and 7B, elements that have functions and structures identical to those of the corresponding elements of the first embodiment shown in FIGS. 6A and 6B are denoted by the respective same reference numerals as in the first embodiment, with "P" added at the end.

In the second embodiment, each of the strength imparting members 32P (contact member) includes a sheet abutting portion 321P, a connected portion 322P, and a rotary support portion 324. The rotary support portion 324 is disposed at an upper right end of the strength imparting member 32P and is in the form of a shaft, the rotary support portion 324 protruding in the backward-forward direction (in the direction perpendicularly intersecting the drawing sheet surface of FIG. 7A). The rotary support portions 324 respectively pass through unillustrated shaft holes provided in a discharge housing 30P of the discharge section 3P. Each of the strength imparting members 32P is supported on the discharge housing 30P in such a way as to pivot around the axis of the respective rotary support portion 324. At this time, the rotary support portion 324 is provided with an unillustrated coil spring (biasing member). The coil spring biases the strength imparting member 32P around the rotary support portion 324 so that the sheet abutting portion 321P of the strength imparting member 32P projects into a first conveyance passage 3AP. The connected portion 322P is defined by a left surface of the strength imparting member 32P, the surface extending vertically. Each of protrusions 43P provided in the intermediate conveyance unit 4P has an oblique surface at its front end, the surface sloping upward in the direction of mounting of the intermediate conveyance unit 4P (FIG. 7B).

Also in the second embodiment, upon insertion of the intermediate conveyance unit 4P in a discharge space 24P from the left, i.e. change from the state shown in FIG. 7A to the state shown in FIG. 7B, the protrusions 43P of the intermediate conveyance unit 4P respectively come into contact with each of the connected portions 322P. At this time, the front end of the protrusion 43 comes into contact with the connected portion 322P to cause the strength imparting member 32P to pivot around the axis of the rotary support portion 324 against the biasing force exerted by the coil spring. This allows the sheet abutting portion 321P of each of the strength imparting members 32P to recede upward and downstream in the direction of conveyance of a sheet P from the first conveyance passage 3AP. This makes it possible to prevent failure in conveyance of a sheet P and generation of abnormal noise in the intermediate conveyance unit 4P. Further, the pivotal movement of the strength imparting members 32P caused by the contact with the protrusions 43P provided in the intermediate conveyance unit 4P allows the strength imparting members 32P to recede from the first conveyance passage 3AP smoothly.

Figure 8A:
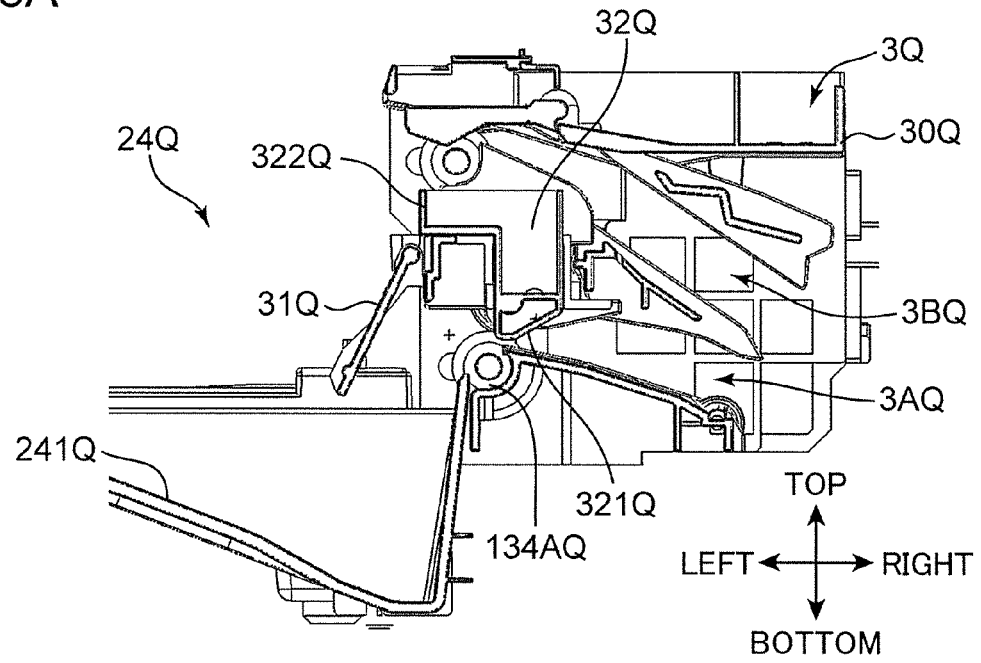
FIGS. 8A and 8B are sectional views illustrating mounting of a conveyance unit in a housing including a sheet discharge portion in a third embodiment of the present disclosure.
Figure 8B:
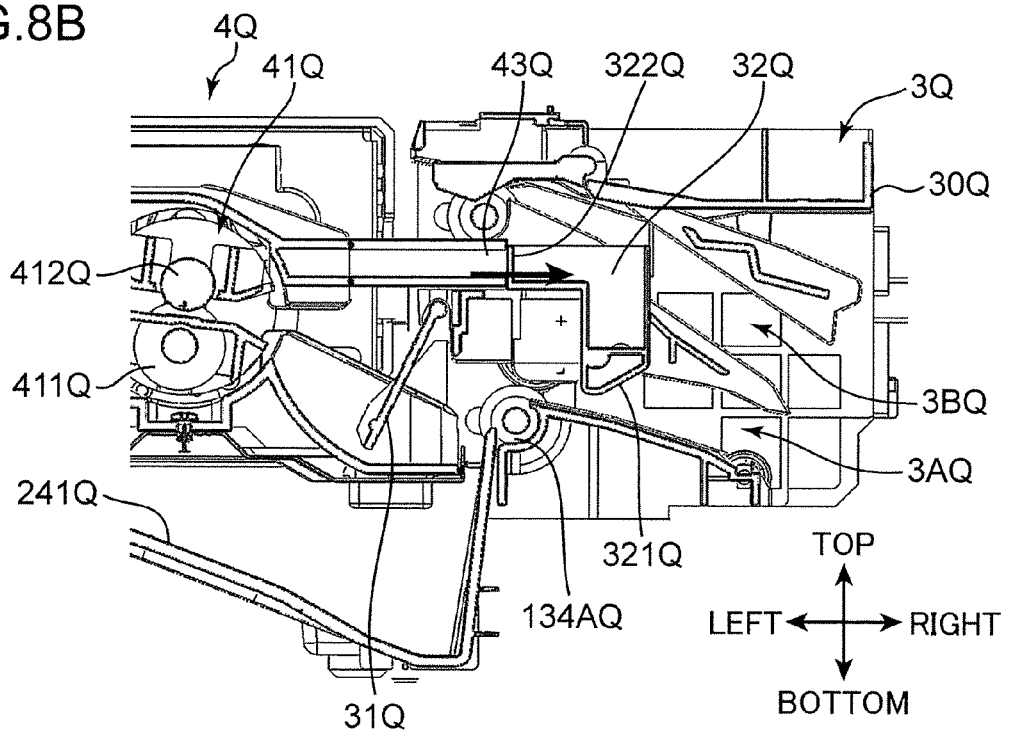

Now an image forming apparatus including a sheet processing device according to a third embodiment of the present disclosure will be described. FIGS. 8A and 8B are sectional views illustrating mounting of an intermediate conveyance unit 4Q (conveyance unit) in a lower housing portion (not shown) including a discharge section 3Q in the third embodiment. The third embodiment differs from the first embodiment in the respect of having a different support structure of each of strength imparting members 32Q. Accordingly, description will be made mainly regarding the difference, and repeated description of other common features will be omitted. In FIGS. 8A and 8B, elements that have functions and structures identical to those of the corresponding elements of the first embodiment shown in FIGS. 6A and 6B are denoted by the same respective reference numerals as in the first embodiment, with "Q" added at the end.

In the third embodiment, each of the strength imparting members 32Q (contact member) includes a sheet abutting portion 321Q and a connected portion 322Q. The strength imparting member 32Q has a substantially L shape, as shown in FIG. 8A. Each of the strength imparting members 32Q is supported on a discharge housing 30Q in such a way as to slide in the direction of conveyance of a sheet P, i.e. in the left-right direction. At this time, unillustrated springs (biasing member) are respectively provided in the spaces between each of the strength imparting members 32Q and the discharge housing 30Q. The spring biases the strength imparting member 32Q leftward so that the sheet abutting portion 321Q of the strength imparting member 32Q projects into a first conveyance passage 3AQ. The connected portion 322Q is defined by a left surface of the strength imparting member 32P, the surface extending vertically. Each of protrusions 43Q provided in the intermediate conveyance unit 4Q has a vertically extending surface at its front end.

Also in the third embodiment, upon insertion of the intermediate conveyance unit 4Q in a discharge space 24Q from the left, i.e. change from the state shown in FIG. 8A to the state shown in FIG. 8B, the protrusions 43Q of the intermediate conveyance unit 4Q respectively come into contact with each of the connected portions 322Q. This causes the strength imparting members 32Q to slide rightward, i.e. in the opposite direction from the direction of conveyance of a sheet P. This allows the sheet abutting portion 321Q of each of the strength imparting members 32Q to recede rightward (upstream in the direction of conveyance of a sheet Q) from the first conveyance passage 3AQ against the biasing force exerted by the respective spring. This makes it possible to prevent failure in conveyance of a sheet P and generation of abnormal noise in the intermediate conveyance unit 4Q.

Figure 9A:
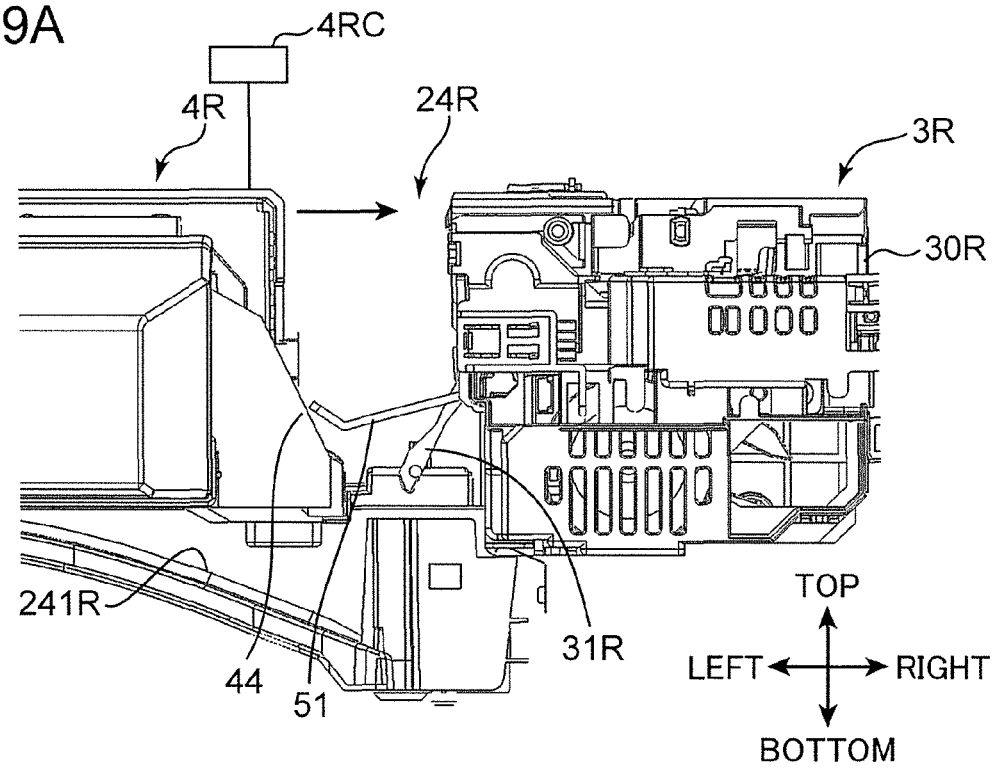
FIGS. 9A and 9B are sectional views illustrating mounting of a conveyance unit in a housing including a sheet discharge portion in a fourth embodiment of the present disclosure.
Figure 9B:
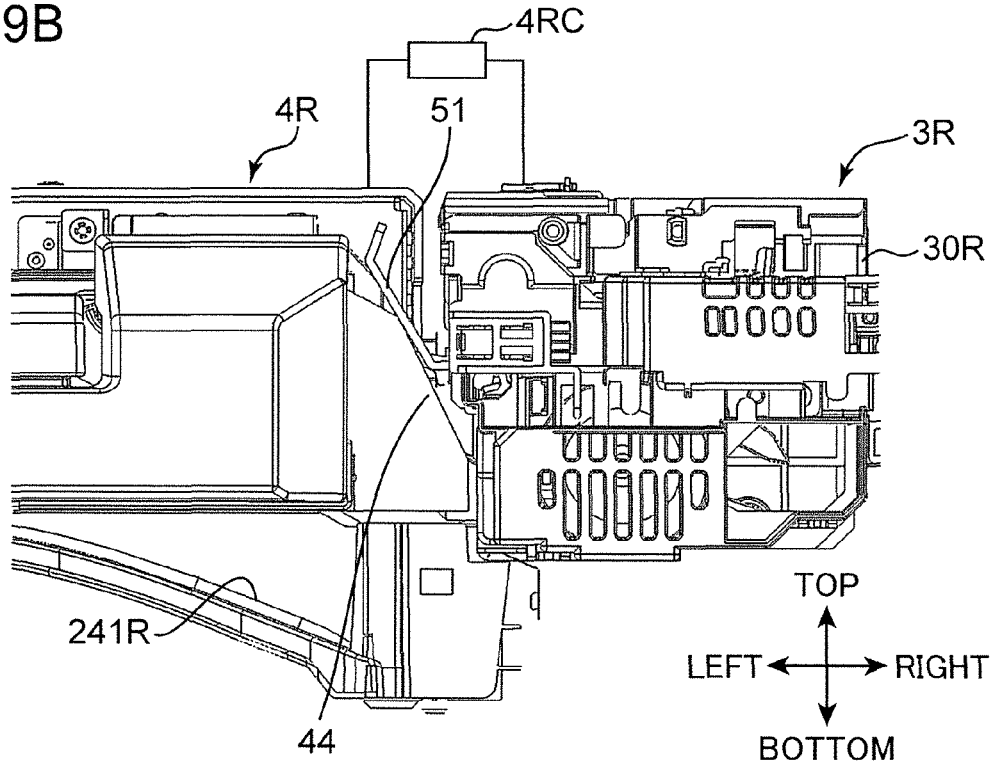
Figure 10:
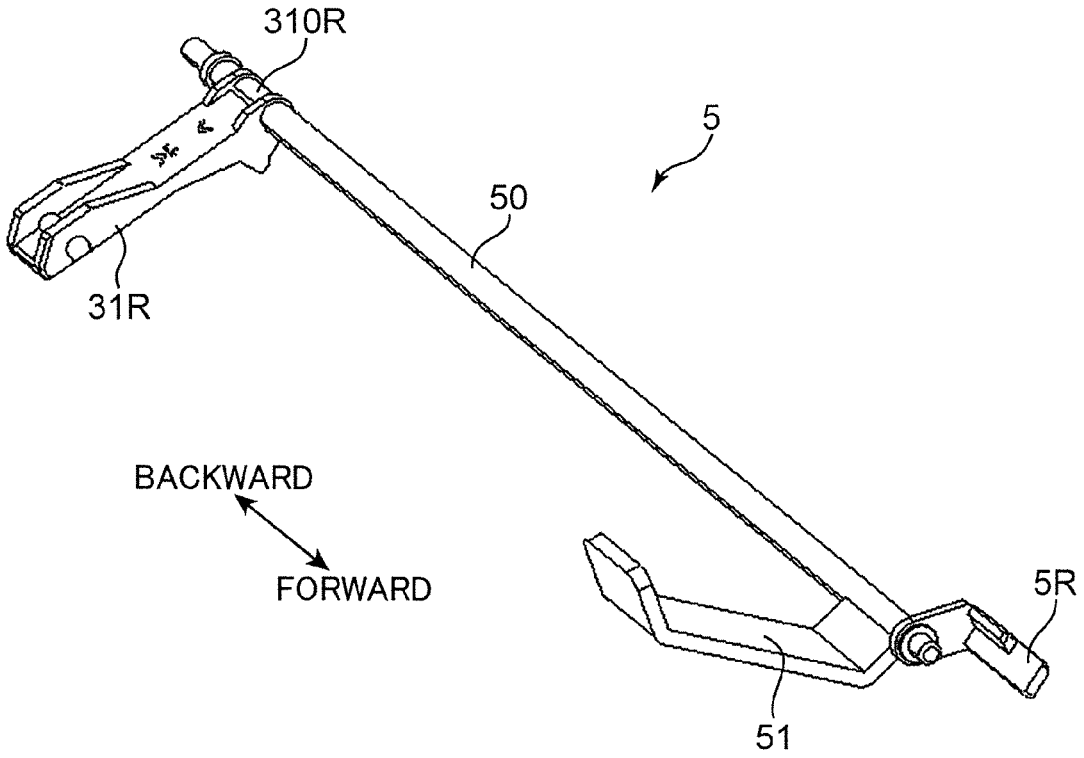
FIG. 10 is a perspective view of an association mechanism according to a fourth embodiment of the present disclosure.
Figure 11:
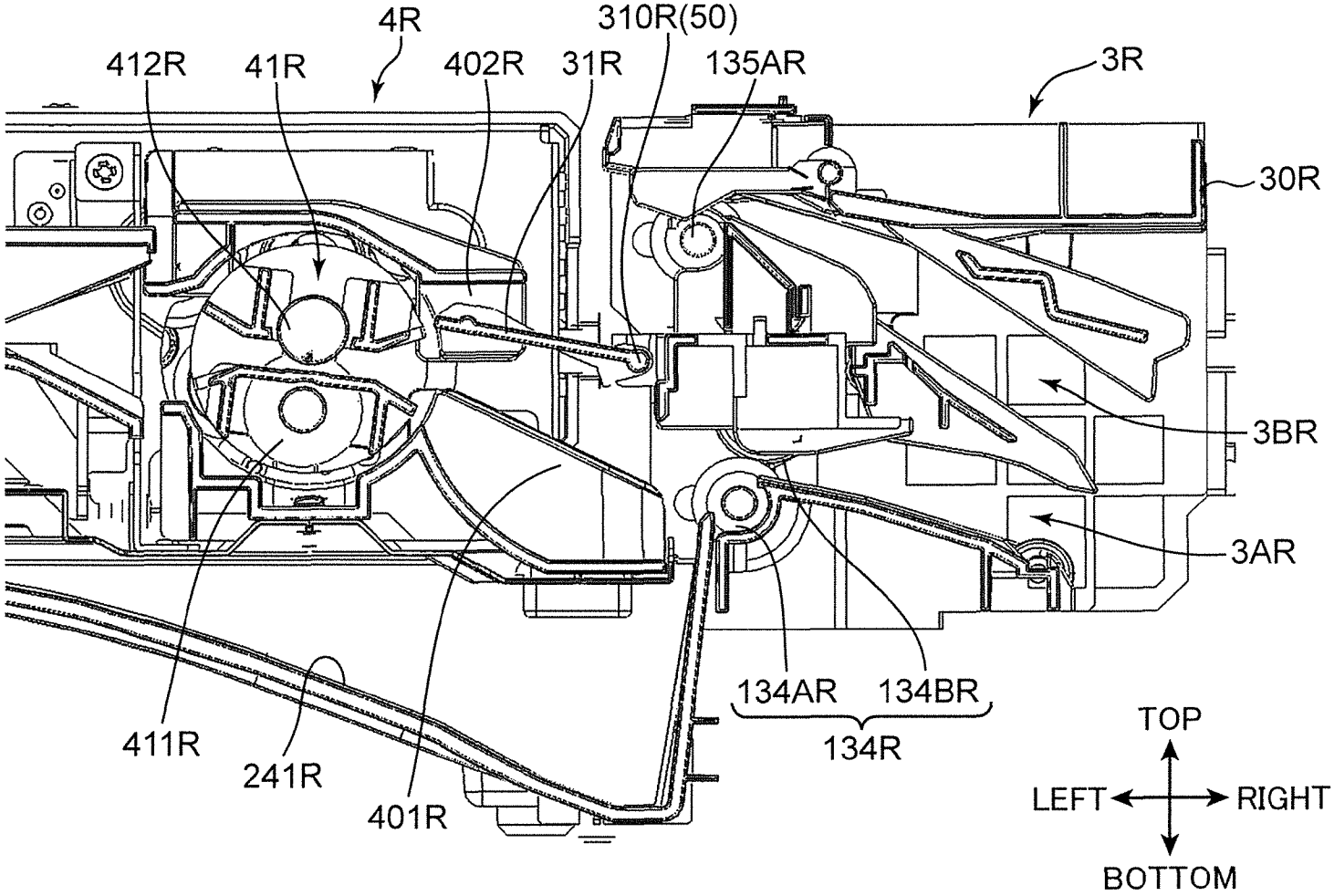
FIG. 11 is a sectional view illustrating the state where the conveyance unit is mounted in the housing including the sheet discharge portion in the fourth embodiment of the present disclosure.

Now an image forming apparatus including a sheet processing device according to a fourth embodiment of the present disclosure will be described. FIGS. 9A and 9B are sectional views illustrating mounting of an intermediate conveyance unit 4R (conveyance unit) in a lower housing portion (not shown) including a discharge section 3R in the fourth embodiment. FIG. 10 is a perspective view of a connection portion 5 according to the fourth embodiment. FIG. 11 is a sectional view illustrating the state where the intermediate conveyance unit 4 is mounted in the lower housing portion including the sheet discharge section 3R. The fourth embodiment differs from the first embodiment in that a detection member 31R, which serves as a contact member, recedes from a first conveyance passage 3AR. Accordingly, description will be made mainly regarding the difference, and repeated description of other common features will be omitted. In FIGS. 9A to 11, elements that have functions and structures identical to those of the corresponding elements of the first embodiment shown in FIGS. 6A and 6B are denoted by the same respective reference numerals as in the first embodiment, with "R" added at the end.

In the fourth embodiment, the detection member 31R constituting a part of an actuator 6 (FIG. 12) functions as the contact member and projects into and retracts from the first conveyance passage 3AR, the actuator 6 detecting a state that a maximum number of sheets P are stacked on a sheet receiving section 241R. The detection member 31R comes into contact with a sheet P in the same manner as the detection member 31 in the first embodiment. Therefore, the detection member 31R also has a function of imparting rigidity to the sheet P (corrugation function). The discharge section 3R includes the connection portion 5 (FIG. 10). The connection portion 5 includes, in addition to the detection member 31R, a shaft 50, a jut 51, and a light shielding member 5R. The shaft 50 is extending in a direction intersecting a sheet conveyance direction. The shaft 50 passes through and is secured in a shaft hole 310R provided in a base end of the detection member 31R, and serves as a pivotal shaft for the detection member 31R. The opposite side ends of the shaft 50 in the forward-backward direction are rotatably and axially supported on a discharge housing 30R of the discharge section 3R. The jut 51 is disposed at a distance from the detection member 31R in the axial direction of the shaft 50, and protrudes from the shaft 50 in a different direction from the detection member 31R. A front end of the jut 51 extends upward. Further, the discharge section 3R includes an unillustrated coil spring fitted on the shaft 50. The coil spring biases the detection member 31R and the jut 51 around the shaft 50 so that the detection member 31R projects into the first conveyance passage 3A, i.e. so that the detection member 31R comes into contact with a sheet P discharged by first pairs of discharge rollers 134R. The light shielding member 5R is disposed at a front end of the shaft 50, and protrudes in the opposite direction from the detection member 31R and has a front end extending in the forward direction. The light shielding member 5R is detected by a first detector 52 and a second detector 53 described later.

On the other hand, the intermediate conveyance unit 4R includes a protruding wall 44 (protrusion) (FIG. 9A). The protruding wall 44 protrudes from the intermediate conveyance unit 4R into the discharge section 3R. The protruding wall 44 has an oblique surface sloping downward in the direction of mounting of the intermediate conveyance unit 4R (to the right).

In the fourth embodiment, upon insertion of the intermediate conveyance unit 4R in a discharge space 24R from the left as shown in FIG. 9A, the protruding wall 44 of the intermediate conveyance unit 4R comes into contact with the front end of the jut 51 of the connection portion 5. At this time, the intermediate conveyance unit 4R is mounted with the protruding wall 44 raising the front end of the jut 51 extending upward. Further, as shown in FIG. 9B, the raising of the jut 51 by the protruding wall 44 causes the shaft 50R, which integrally includes the jut 51 and the detection member 31R, to pivot around its axis against the biasing force exerted by the above-mentioned coil spring. This allows the detection member 31R to recede upward from the first conveyance passage 3AR as shown in FIG. 11. Further, a lower carry-in portion 401R of the intermediate conveyance unit 4R is formed with a cutout similar to a cutout 401A shown in FIG. 4. This can prevent the detection member 31R from coming into contact with the lower carry-in portion 401R in the course of pivotal movement. The configuration as described also makes it possible, when a sheet P formed with an image is delivered from the discharge section 3R to the intermediate conveyance unit 4R, to prevent the detection member 31R from coming into contact with a surface of the sheet P and thereby prevent the sheet P from entering the intermediate conveyance unit 4R with undulations formed thereon. This can prevent failure in conveyance of the sheet P and generation of abnormal noise in the intermediate conveyance unit 4R.

Figure 12:
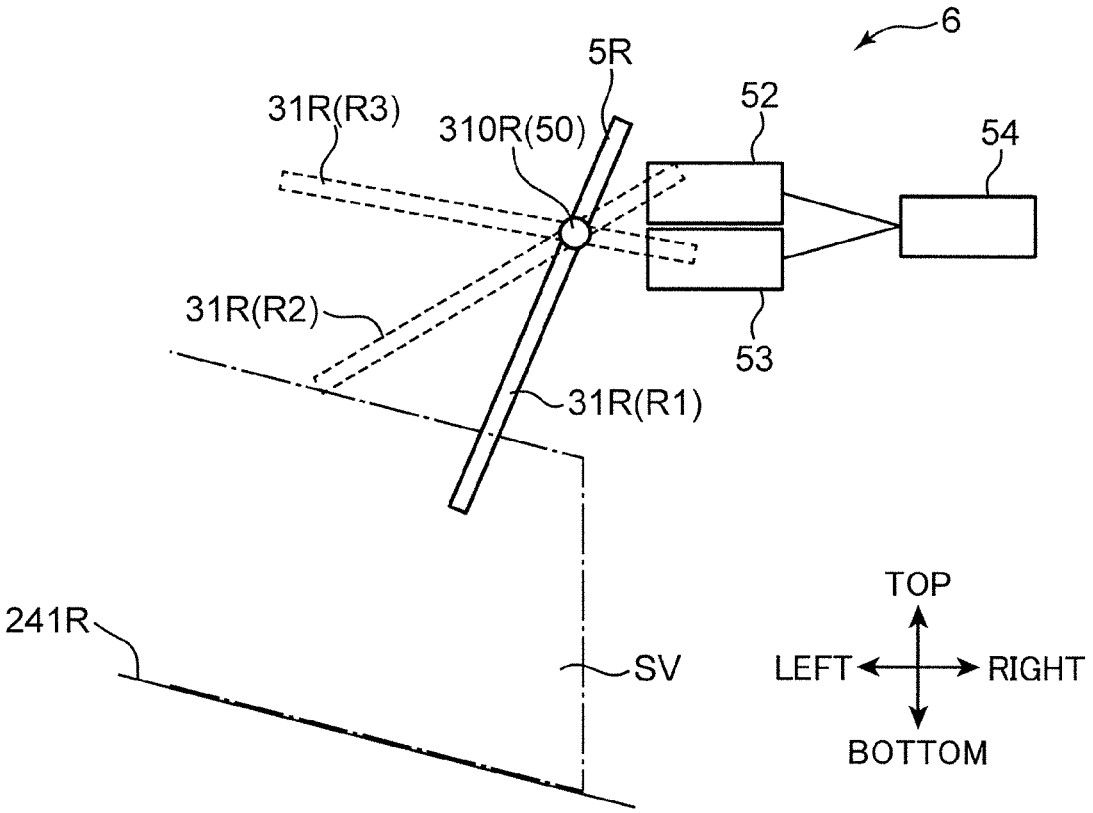
FIG. 12 is a schematic view of an actuator according to the fourth embodiment of the present disclosure.

Further, in the fourth embodiment, the actuator 6 includes, in addition to the above-described connection portion 5, the first detector 52, the second detector 53, and a controller 54, the actuator 6 detecting the state that the maximum number of sheets are stacked on the sheet receiving section 241R. FIG. 12 is a schematic view for explaining the movement of the detection member 31R and the light shielding member 5R in the actuator 6. The first detector 52 and the second detector 53 each include a PI sensor, and are placed in the discharge section 3R (FIG. 9A) and face the light shielding member 5R. The first detector 52 is disposed above the second detector 53. The controller 54 is electrically connected to the first detector 52 and the second detector 53 and controls these detectors.

In the case where the intermediate conveyance unit 4R is not mounted in the image forming apparatus 1, when a sheet P is discharged on the sheet receiving section 241R, the detection member 31R turns around the axis of the shaft 50 from a first position R1 owing to the pushing of the sheet P. When the maximum number of sheets P are stacked on the sheet receiving section 241R, the detection member 31R contacting with an upper surface (top) of the sheet P is turned a first angle from the first position R1 to a second position R2 shown in FIG. 12. At this time, the first detector 52 detects the light shielding member 5R which has moved integrally with the detection member 31R. This allows the controller 54 to detect the state that a stack of sheets SV having the maximum number of sheets is placed on the sheet receiving section 241R.

On the other hand, when the intermediate conveyance unit 4R is mounted in the image forming apparatus 1, the protruding wall 44 raises the jut 51 as described above. This causes the detection member 31R to turn from the first position R1 by a second angle greater than the first angle to lie at a third position R3 shown in FIG. 12. At this time, the second detector 53 detects the light shielding member 5R which has moved integrally with the detection member 31R. This allows the controller 54 to detect the mounting of the intermediate conveyance unit 4R. Further, the receding movement of the detection member 31R from the first conveyance passage 3AR (FIG. 11) makes it no longer necessary to detect the number of sheets stacked on the sheet receiving section 241R. Accordingly, the controller 54 causes, when the second detector 53 detects the mounting of the intermediate conveyance unit 4R, the first detector 52 to stop detection of a stacking state of sheets P.

The sheet processing device and the image forming apparatus 1 including the same according to each of the first to fourth embodiments of the present disclosure have been described. However, the present disclosure is not limited to the above-described embodiments and, for example, the following modified embodiments may be adopted.

(1) In the above-described embodiment, the first detector 52 and the second detector 53 each include a PI sensor (optical sensor). However, the present disclosure is not limited to this configuration. In other embodiments, each of the first detector 52 and the second detector 53 may alternatively include a piezoelectric element.

(2) Further, the mounting of the intermediate conveyance unit 4R (FIG. 11) in the lower housing portion may alternatively be detected by a configuration other than the second detector 53 (FIG. 12). In modified embodiments, the intermediate conveyance unit 4R may include a connection portion 4RC (see FIG. 9A) (connector) electrically connectable to the lower housing portion. The connection portion 4RC may be provided as a power connector for supplying a drive voltage from the lower housing portion to the intermediate conveyance unit 4R, or a connector for sending and receiving a control signal, so that the controller 54 may cause the first detector 52 to stop detection of a stacking state of sheets P upon connection of the connection portion 4RC of the intermediate conveyance unit 4R to the lower housing portion (discharge section 3R) (FIG. 9B).

(3) In the above-described embodiment, the sheet discharge section 241, which exemplifies the sheet stacking portion, is disposed on the top surface of the lower housing portion 21. However, the present disclosure is not limited to this configuration. Further, the present disclosure is not limited to the configuration that the sheet stacking portion is disposed inside the image forming apparatus 1. The sheet stacking portion may be in the form of a tray (not shown) which is, for example, mountable on the left side of the lower housing portion 21. In this case, the tray may be detached from the lower housing portion 21 to allow the intermediate conveyance unit 4 to be mounted on the left side of the lower housing 21 over the tray mounted space.

(4) In the above-described embodiment, the conveyance unit is exemplified by the intermediate conveyance unit 4. However, the present disclosure is not limited to this configuration. In modified embodiments, the conveyance unit may alternatively be provided as a post-processing unit for performing a specific post-processing on a sheet P discharged by the first pairs of discharge rollers 134. In this case, a configuration may be provided to allow the post-processing unit to be mounted in the discharge space 24 of the lower housing portion 21, or alternatively, on the left side of the lower housing portion 21.

(5) In the above-described embodiment, the intermediate conveyance unit 4 enters the discharge space 24 from the left side of the image forming apparatus 1 to face the discharge section 3, thereby being mounted to the lower housing portion 21. However, the present disclosure is not limited to this configuration. In modified embodiments, an alternative configuration may be provided to allow the intermediate conveyance unit 4 to enter the discharge space 24 from the front of the image forming apparatus 1 to face the discharge section 3, thereby being mounted to the lower housing portion 21. In this case, for example, the oblique surface of the connected portion 322 of each of the strength imparting members 32 and the oblique surface of each of the protrusions 43 of the intermediate conveyance unit 4 shown in FIGS. 6A and 6B may be modified to slope in the forward-backward direction to similarly allow movement of the strength imparting members 32.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A sheet processing device, comprising:

a housing;

a sheet stacking portion disposed in the housing and having a top surface for allowing sheets to be stacked thereon;

a sheet discharge portion disposed in the housing and facing a space over the sheet stacking portion, the sheet discharge portion including a discharge housing and a pair of discharge rollers configured to discharge a sheet to the sheet stacking portion;

a contact member disposed in the sheet discharge portion, and movable to project into a sheet conveyance passage to come into contact with a surface of the sheet;

two guide portions provided in the discharge housing;

a biasing member biasing the contact member so that the contact member projects into the sheet conveyance passage;

a conveyance unit configured to be selectively mounted in the space of the housing to thereby face the sheet discharge portion in a predetermined mounting direction, and configured to receive a sheet delivered by the pair of discharge rollers and convey the sheet; and an association mechanism operable to cause the contact member to recede from the sheet conveyance passage against the biasing force of the biasing member in association with the mounting of the conveyance unit in the housing, the association mechanism including a protrusion protruding from the conveyance unit into the sheet discharge portion;

the contact member including a sheet abutting portion being able to come into contact with the surface of the sheet and an abutted portion being able to be contacted by the protrusion, the contact member being supported between the two guide portions to slide in contact with the guide portions in a direction intersecting a sheet conveyance direction;

the protrusion defining a first oblique surface sloping down in the mounting direction;

the abutted portion of the contact member defining a second oblique surface sloping up toward the protrusion of the conveyance unit; and wherein upon mounting the conveyance unit into the housing, the first oblique surface of the protrusion comes into contact with the second oblique surface of the contact member to cause the contact member to slide along the pair of the guide portions and thereby recede upwardly from the sheet conveyance passage.

2. A sheet processing device according to claim 1, wherein the conveyance unit serves as an intermediate conveyance unit operable to transfer a sheet to a post-processing device in which a specific post-processing on the sheet is performed.

3. An image forming apparatus, comprising:

an image forming section operable to form an image on a sheet;

a sheet processing device according to claim 1 operable to discharge the sheet formed with the image.

4. A sheet processing device according to claim 1, wherein the guide portions are parallel to one another.

5. A sheet processing device according to claim 4, wherein the contact portion moves linearly between the guide portions.

6. A sheet processing device according to claim 1, wherein the contact portion moves linearly between the guide portions.

* * * * *